US007563125B2

(12) United States Patent
Pepe et al.

(10) Patent No.: US 7,563,125 B2
(45) Date of Patent: Jul. 21, 2009

(54) JACK ASSEMBLY FOR REDUCING CROSSTALK

(75) Inventors: Paul John Pepe, Clemmons, NC (US); Christine Dooley, Lewisville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/938,427

(22) Filed: Nov. 12, 2007

(65) Prior Publication Data

US 2009/0124136 A1 May 14, 2009

(51) Int. Cl.
*H01R 4/24* (2006.01)

(52) U.S. Cl. ..... 439/417

(58) Field of Classification Search ..... 439/417, 439/395, 404, 406–407, 443, 391, 455, 676
See application file for complete search history.

(56) References Cited

U.S. PATENT DOCUMENTS 6,358,092 B1 3/2002 Seimon et al.
6,579,116 B2 6/2003 Brennan et al.
6,592,396 B2 7/2003 Pepe et al.
6,767,241 B1 * 7/2004 Abel et al. ..... 439/417
7,384,298 B2 * 6/2008 Caveney et al. ..... 439/404
7,396,999 B2 * 7/2008 Miller et al. ..... 174/135
7,404,739 B2 * 7/2008 Sheilds et al. ..... 439/608
2006/0246784 A1 11/2006 Aekins et al.
2007/0026736 A1 2/2007 Itano et al.

OTHER PUBLICATIONS

Assembly, SL 110 Jack, CAT 6, Tyco Electronics, Jul. 13, 2007, 1 pg.
SL, KL, and Secure SL Series, 110Connect Modular Jacks, Instruction Sheet 408-8417, Oct. 16, 2007, 2 pgs.
Assembly, SL 110 Jack, Shielded, Cat 6, Tyco Electronics, Jul. 13, 2007 1 pg.

* cited by examiner

*Primary Examiner*—Jean F Duverne

(57) ABSTRACT

A jack assembly is provided and includes a jack housing and a contact sub-assembly joined to a rear end of the housing. The contact sub-assembly includes a plurality of conductor channels that each hold an insulation displacement contact (IDC) therein. The jack assembly also includes a connector cap that is mounted to the jack housing and is formed from a non-conductive material having conductive particles dispersed therein. The connector cap has a body arranged to at least partially cover the contact sub-assembly. The body has an inner surface and a plurality of crosswalls projecting outwardly from the inner surface. Each crosswall has a gap and is positioned to be inserted into one of the plurality of conductor channels such that the IDC fits within the gap.

20 Claims, 8 Drawing Sheets

JACK ASSEMBLY FOR REDUCING CROSSTALK

BACKGROUND OF THE INVENTION

The invention relates generally to electrical connectors and assemblies, and more particularly to jack assemblies that are configured to reduce crosstalk between adjacent electrical connectors and/or assemblies.

Alien crosstalk is electromagnetic noise that can occur in a cable that runs alongside one or more other signal-carrying cables or in a connector that is positioned proximate to another connector. The term "alien" arises from the fact that this form of crosstalk occurs between different cables in a bundle or different connectors in a group, rather than between individual wires or circuits within a single cable or connector. Alien crosstalk affects the performance of a communications system by reducing the signal-to-noise ratio (S/N). One possible solution is to separate the cables and/or connectors from each other by a predetermined distance so that the likelihood of alien crosstalk is minimized. This solution, however, reduces the density of cables and/or connectors that may be used per unit of area.

In one electrical connector that is adapted for reducing crosstalk between adjacent electrical connectors, the connector includes a jack that is configured to receive a plug (e.g., RJ-45) at a front end of the housing. Signal contacts extend through the jack and terminate at insulation displacement contacts (IDC's), which project outward from a contact sub-assembly. Individual conductor wires from a stripped cable are pressed into and held within the IDC by a connector cap that is placed over the contact sub-assembly. The connector cap includes one or more metallic shield enclosures positioned proximate to or around the contact sub-assembly and IDC's. The shield enclosure reduces the likelihood of crosstalk transmitted between adjacent electrical connectors. However, the use of a shield enclosure requires extra parts and/or material when manufacturing the connector and also requires additional manufacturing steps to make the connector. Furthermore, certain paints may not be applied to the metallic material of the shield enclosure, which may be desired in order to color-code and/or label the electrical connectors.

In other electrical connectors, the plug or jack may have a conductive bar where the material used to make the bar includes plastic mixed with conductive fiber rods. The insulated wires within the plug or jack pass over and/or through the bar, which is designed to reduce cross-talk within the plug or jack. However, the bar is an additional component that must be positioned within the plug or jack and thus may only be used where sufficient space exists for the bar. Furthermore, installing the bar requires additional steps in manufacturing the plug or jack.

Other connector designs for reducing alien crosstalk include molding the connector cap with a conductive plastic interior and a resistive outer skin or coating the connector cap with a conductive resin. However, these variations also require extra material and/or steps to manufacture the electrical connector. Thus, there is a need for electrical connectors that reduce the crosstalk between adjacent connectors and that do not require additional parts or processes to construct the electrical connector.

BRIEF DESCRIPTION OF THE INVENTION

In one embodiment, a jack assembly is provided and includes a jack housing having front and rear ends and a contact sub-assembly joined to the rear end of the jack housing. The front end of the jack housing forms an opening to a cavity for receiving a plug and the contact sub-assembly includes a plurality of arms extending outwardly from the rear end of the jack housing. The arms are spaced apart to define a plurality of conductor channels. The contact sub-assembly also includes an insulation displacement contact (IDC) held within each of the plurality of conductor channels. The IDC extends across the conductor channel such that, when a conductor is inserted into the IDC, the conductor rests within the conductor channel. The jack assembly also includes a connector cap mounted to the jack housing. The connector cap has a body arranged to at least partially cover the contact sub-assembly. The cap being formed from a non-conductive material having conductive particles dispersed therein. The body including an inner surface and a plurality of crosswalls projecting outwardly from the inner surface. Each crosswall has first and second wall portions separated by a gap, where each crosswall is positioned to be inserted into one of the plurality of conductor channels such that the IDC fits within the gap.

Optionally, the first and second wall portions are spaced apart from the IDC to avoid formation of a conductive path between the first and second wall portions and the conductor held within the IDC. Also, the jack housing may also be fabricated from a non-conductive material having conductive particles dispersed therein, where the cavity is configured to avoid formation of a conductive path between the jack housing and contacts within the housing.

In another embodiment, an electrical connector cap is provided. The connector cap is configured to push a plurality of conductors into corresponding insulation displacement contacts (IDCs) when the connector cap is mounted to a jack housing. Each IDC extends across a conductor channel such that when a conductor is inserted into the IDC the conductor rests within the conductor channel. The connector cap includes a body that is formed from a non-conductive material having conductive particles dispersed therein. The body has an inner surface. The connector cap also includes a plurality of crosswalls that project outwardly from the inner surface. Each crosswall has first and second wall portions separated by a gap. Also, each crosswall is positioned to be inserted into a corresponding conductor channel such that the IDC fits within the gap when the first and second wall portions push the corresponding conductor into the conductor channel.

DETAILED DESCRIPTION OF THE INVENTION

Figure 1:
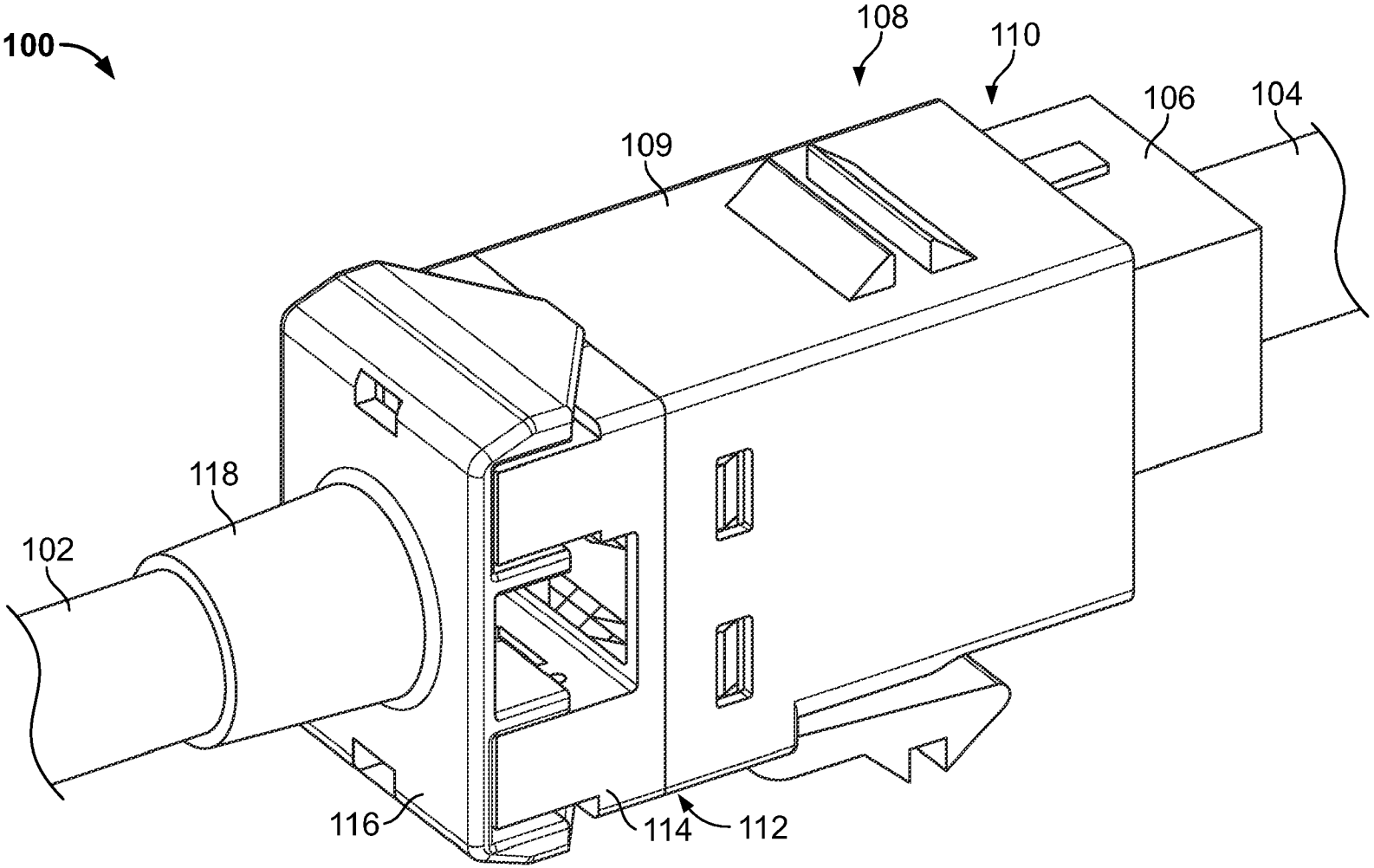
FIG. 1 is a rear perspective view of an electrical connector assembly formed in accordance with one embodiment of the present invention.

FIG. 1 illustrates a rear perspective view of an electrical connector assembly 100 formed in accordance with one embodiment. The electrical connector assembly 100 may be used to transmit high speed electronic signals between multi-conductor cable 102 and multi-conductor cable 104. The connector assembly 100 includes a plug 106 connected to a jack assembly 108. The plug 106 is shown as an RJ-45 type in FIG. 1, but the plug 106 may be any plug type or variation. Furthermore, the multi-conductor cables 102 and 104 may be, for example, twisted pair cables having a plurality of insulated wire conductors 190 (shown in FIG. 2) running throughout the corresponding cable. The jack assembly 108 may include a jack housing 109 having a front end 110 where the plug 106 is received and a rear end 112. The jack assembly 108 may also include a contact sub-assembly 114 that is coupled to the rear end 112 and a connector cap 116 that connects to and at least partially covers the contact sub-assembly 114. As shown, the connector cap 116 has a nozzle 118 extending axially in a rear direction. The nozzle 118 is configured to receive and provide strain relief for the cable 102 when the cable 102 is engaged with the contact sub-assembly 114. It is noted that the electrical connector assembly 100 in FIG. 1 is only an exemplary embodiment and many other variations and types of connectors or connector assemblies may be used.

As will be discussed in further detail below, the connector cap 116 and/or the jack housing 109 are fabricated from a non-conductive material having conductive particles dispersed therein. The conductive particles form a conductive network that facilitates providing EMI/RFI shielding for the electrical connector assembly 100. As such, the connector cap 116 and/or the jack housing 109 are adapted to avoid formation of a conductive path. More specifically, the connector cap 116 may be configured to avoid forming a conductive path with the conductors of the cable 102 and the jack housing 109 may be configured to avoid forming a conductive path with an electrical contact 134 (FIG. 2).

Figure 2:
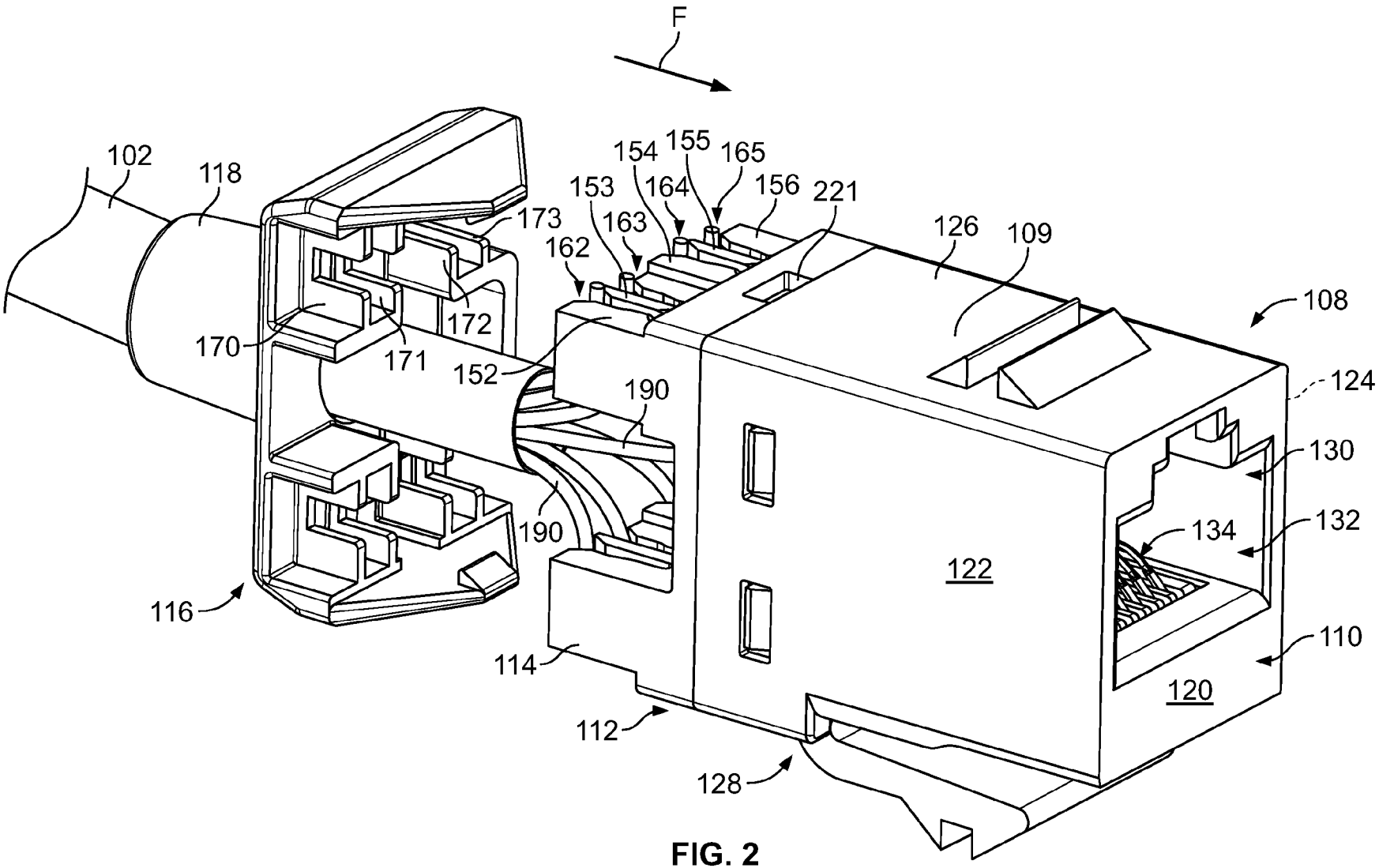
FIG. 2 is a front perspective view of a jack assembly that may be used with the electrical connector assembly shown in FIG. 1.

FIG. 2 illustrates a front perspective view of the jack assembly 108 before the connector cap 116 engages the contact sub-assembly 114. The jack housing 109 has a substantially rectangular shape and includes a front face 120, opposing sides 122 and 124, a top side 126, and a bottom side 128. The front face 120 forms an opening 130 that leads to a cavity 132 that is configured to receive the plug 106 (shown in FIG. 1). The cavity 132 includes an array of the electrical contacts 134 that extend through the jack housing 109 from the front end 110 to the rear end 112 and terminate at a corresponding insulation displacement contact (IDC) 180 (shown in FIG. 3) on the contact sub-assembly 114. Also shown, the contact sub-assembly 114 is attached to the jack housing 109 by inserting the contact sub-assembly 114 through the rear end 112 of the jack housing 109.

Figure 3:
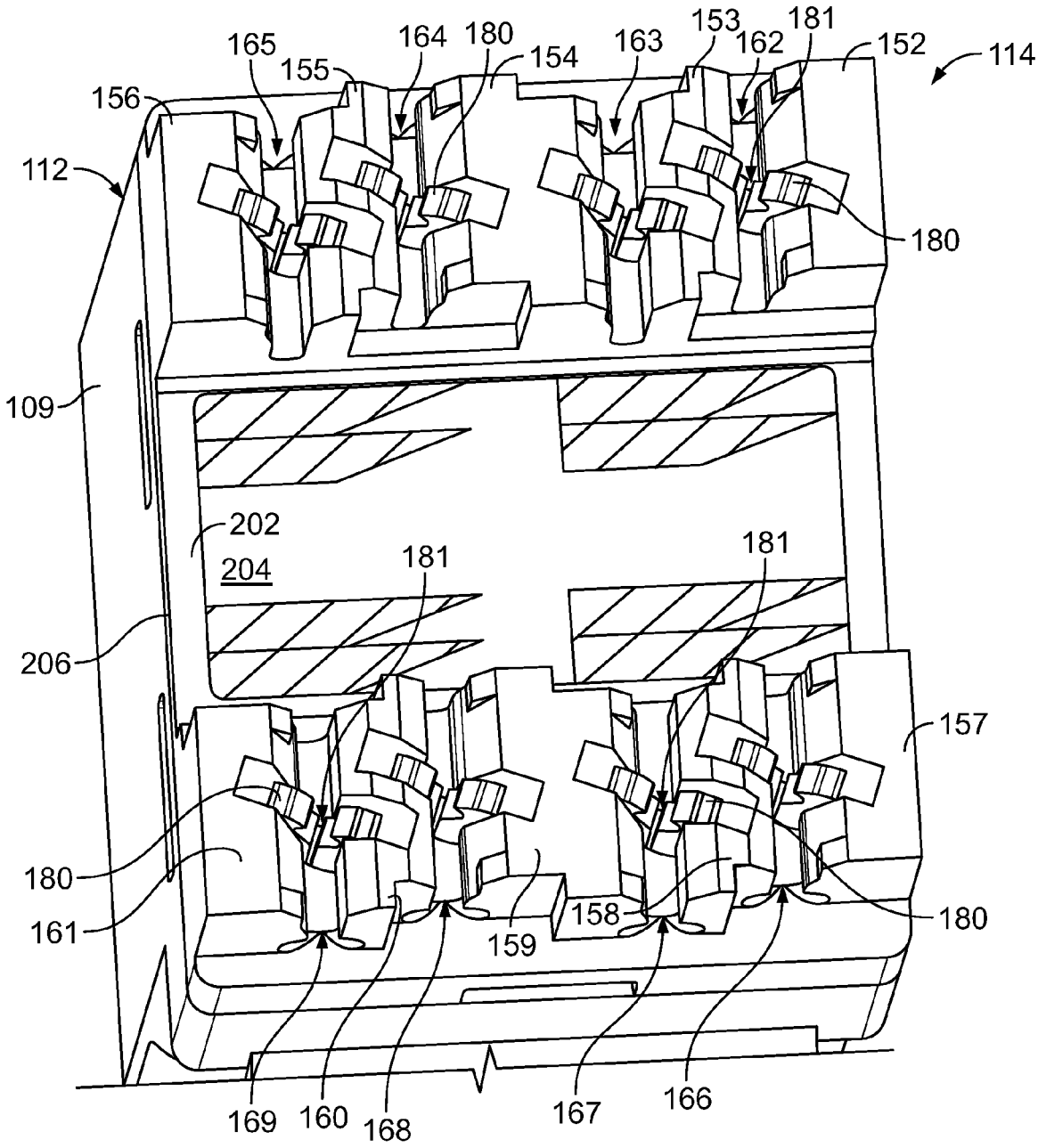
FIG. 3 (PRIOR ART)
FIG. 3 is a perspective view of a contact sub-assembly that may be used with the jack assembly shown in FIG. 2.

As shown in FIG. 2, in order to connect the cable 102 to the jack assembly 108, a stripped end of the cable 102 is first inserted through the nozzle 118 and advanced toward the contact sub-assembly 114. FIG. 3 is a front perspective view of the contact sub-assembly 114. As shown in FIGS. 2 and 3, the contact sub-assembly 114 includes a plurality of arms 152-156 that project axially outward from the contact sub-assembly 114. The arms 152-156 define a plurality of conductor channels 162-165. More specifically, the arms 152 and 153 define the conductor channel 162 therebetween; the arms 153 and 154 define the conductor channel 163 therebetween; the arms 154 and 155 define the conductor channel 164 therebetween; and the arms 155 and 156 define the conductor channel 165 therebetween. Likewise, as shown in FIG. 3, the arms 157-161 define a plurality of conductor channels 166-169. More specifically, the arms 157 and 158 define the conductor channel 166 therebetween; the arms 158 and 159 define the conductor channel 167 therebetween; the arms 159 and 160 define the conductor channel 168 therebetween; and the arms 160 and 161 define the conductor channel 169 therebetween.

In FIG. 3, the contact sub-assembly 114 also includes a back covering 202 that encloses and holds a circuit board (not shown) within the jack housing 109. The covering 202 includes an outer surface 204 and a covering edge 206 that defines a perimeter of the covering 202. The arms 152-161 project axially outward away from the outer surface 204 and the rear end 112 of jack housing 109 at an angle that is substantially perpendicular to the outer surface 204. In one embodiment, the arms 152-156 and/or the arms 157-161 are integrally formed from the same structure. Also shown, the contact sub-assembly 114 has a plurality of IDC's 180 where each has a slot 181 that is configured to hold a conductor 190 (FIG. 2) when the electrical connector assembly 100 is in operation. As such, the slot 181 of each IDC is oriented within the corresponding conductor channel so that the slot 181 may receive the conductor 190.

Referring again to FIG. 2, the connector cap 116 includes a plurality of crosswalls 170-173. Each crosswall 170-173 is associated with one of the conductor channels 162-165 and is configured to fit into the associated conductor channel 162-165. A wire conductor 190 is placed within or proximate to each conductor channel 162-165. An axial force F is then applied to the connector cap 116 thereby advancing the connector cap 116 toward the contact sub-assembly 114. The crosswalls 170-173 push the corresponding wire conductor 190 into the associated conductor channel. As will be discussed in greater detail below with respect to FIG. 5, sidewalls and respective latch projections cooperate together in engaging corresponding latch openings thereby coupling the connector cap 116 to the contact sub-assembly 114.

The connector cap 116 is fabricated from a non-conductive material having conductive particles dispersed therein. The conductive particles may include, for example, a conductive powder or conductive fibers. For example, the conductive particles may be carbon powders, carbon fibers, silver coated glass beads or fibers, nickel coated carbon fibers, or stainless steel fibers. The non-conductive material may be any of various types of plastic. By way of example, the connector cap 116 may be formed in an injection molding process that uses pellets containing the non-conductive material and the conductive particles. The pellets may be made by adding a conductive powder or conductive fibers to molten resin. After extruding and cooling the resin mixture, the material may be chopped or formed into pellets. Alternatively, the conductive powder or fiber may be added during an injection molding process.

The conductive particles form a conductive network that facilitates providing EMI/RFI shielding. The conductive particles may have a variety of shapes, such as being in the shape of rods or spheres. When the connector cap 116 is ultimately formed, the conductive particles may be evenly distributed or dispersed throughout. Alternatively, the conductive particles may be distributed in clusters. Further, during the molding process, the conductive particles may be forced to move (e.g., through magnetism or applied current) to certain areas so that the density of the conductive particles is greater in desired areas.

In one embodiment, the non-conductive material includes a polypropolene or other thermoplastic polymer and the conductive particles are stainless steel fibers. Additional fillers (e.g., glass, carbon fillings) may be added to the material to increase the strength or flexibility or to obtain other desired properties. In one embodiment, the connector cap 116 is integrally formed and molded from a conductive material and does not have a conductive coating, shield, or separate layer applied to the outer and/or inner surfaces. Further, in one embodiment, the connector cap 116 and/or the jack housing 109 may be painted in order to color-code the jack assembly 108. Those skilled in the art understand that metallic shields or coatings may be difficult to paint. Moreover, the jack housing 109 and the contact sub-assembly 114 may be integrally formed. One skilled in the art would know additional suitable alternative materials and fabrication methods.

Figure 4:
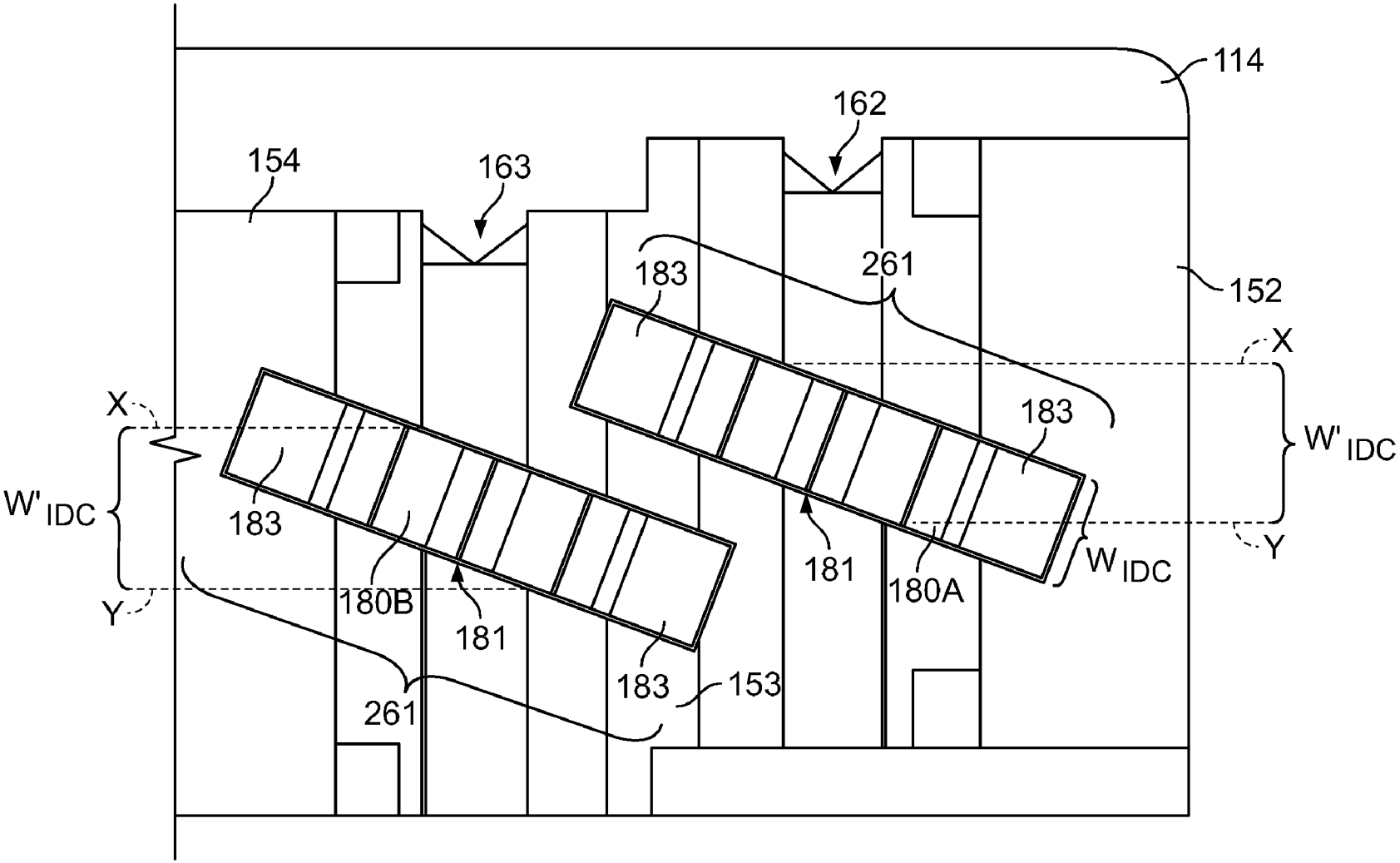
FIG. 4 (PRIOR ART)
FIG. 4 is an enlarged planar view of the contact sub-assembly shown in FIG. 3 illustrating a conductor channel and an insulated displacement contact (IDC).

FIG. 4 is an enlarged planar view of a portion of the contact sub-assembly 114 shown in FIG. 3. Although the following description relates specifically to the arms 152-154 and conductor channels 162 and 163, the description may similarly be applied to the arms 155-161 and the channels 164-69. As shown, IDC's 180A and 180B are each surrounded by adjacent arms. More specifically, the arms 152 and 153 are configured to surround the IDC 180A and the arms 153 and 154 are configured to surround the IDC 180B. More specifically, each arm 152-154 includes a cut-out 183 for receiving a portion of the IDC 180. The adjacent cut-outs 183 form an IDC channel 261 that intersects a corresponding conductor channel. When the IDC channel 261 and the corresponding conductor channel form an angle less than or greater than 90°, the IDC's 180A and 180B may be positioned closer to each other thereby increasing the density of IDC's 180 that may be used by the jack assembly 108.

Also shown in FIG. 4, the slot 181 rests within the corresponding conductor channel 162 or 163 and is oriented to receive one conductor 190 (FIG. 2). Each IDC 180 has a width $W_{IDC}$. In one embodiment, the IDC 180 crosses the conductor channel 162 or 163 at a non-orthogonal angle. In this arrangement, the IDC 180 has an operative width $W'_{IDC}$, which is the distance along the conductor channel 162 from position X to position Y. The term "operative width," as used herein, is the distance necessary for the corresponding crosswall to clear the IDC 180 when the crosswall is inserted into the conductor channel 162 or 163. Thus, when the IDC 180 forms a 90° angle with respect to the conductor channel, then $W'_{IDC}=W_{IDC}$. As will be discussed below, when the connector cap 116 (FIG. 2) is a conductive material the corresponding crosswall may have a gap G that is greater than the operative width $W'_{IDC}$ in order to avoid formation of a conductive path between a portion of the connector cap 116 and the conductor 190 held within the IDC 180.

Figure 5:
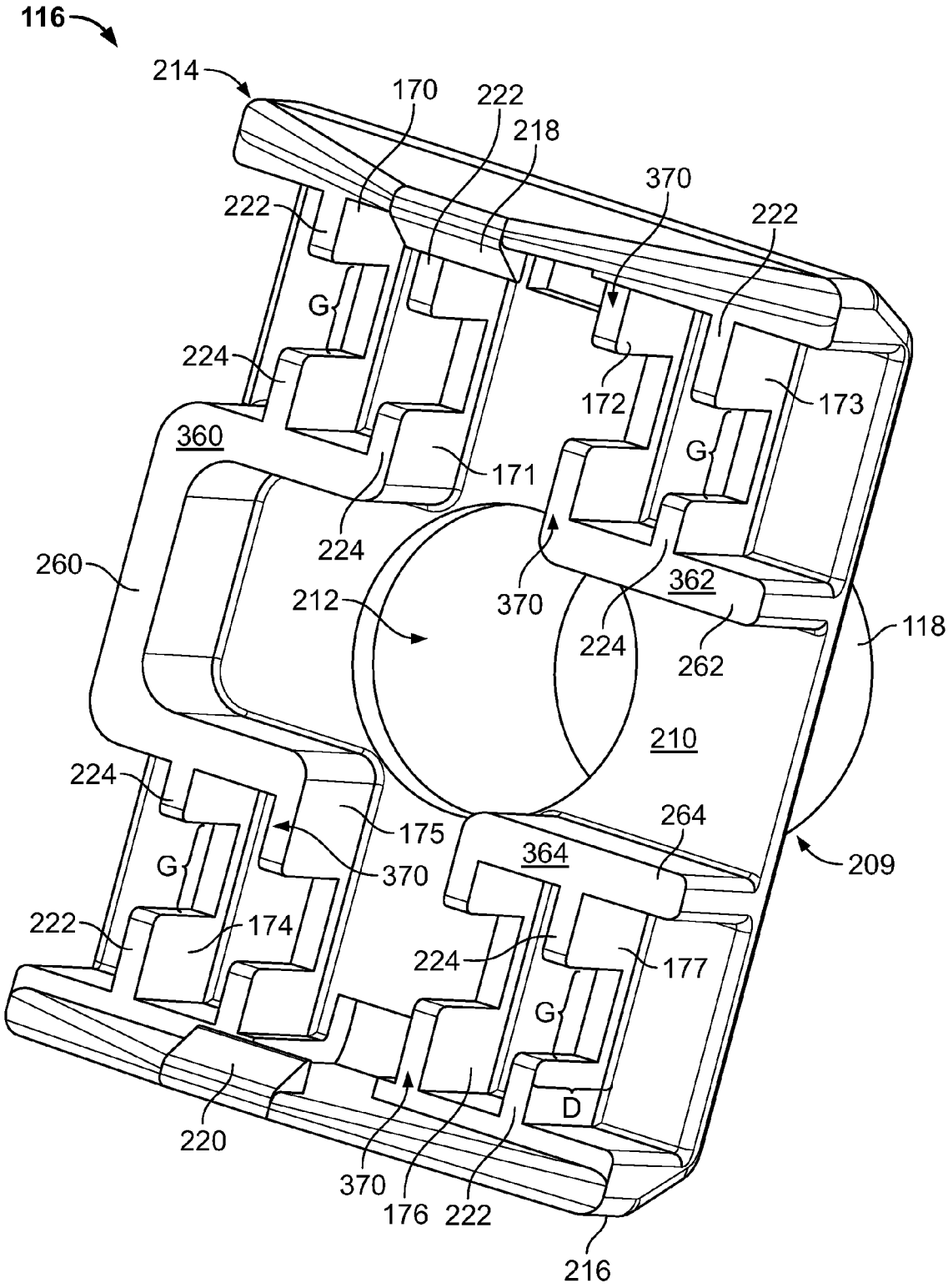
FIG. 5 is a perspective view of the connector cap that is used with the jack assembly shown in FIG. 2.

FIG. 5 is a perspective view of the connector cap 116 formed in accordance with one embodiment. As discussed above, the connector cap 116 includes the crosswalls 170-173. The connector cap 116 may also include crosswalls 174-177. Furthermore, the connector cap 116 has a body 209 that includes an inner surface 210 and an outer surface (not shown). The inner surface 210 faces the contact sub-assembly 114 (FIG. 2) when the connector cap 116 engages the contact sub-assembly 114. In FIG. 5, the inner surface 210 has a nozzle opening 212 that leads into and through the nozzle 118. The connector cap 116 may also include opposing sidewalls 214 and 216 that extend outward at a substantially perpendicular angle with respect to the inner surface 210. Each sidewall 214, 216 may taper or narrow as the sidewall 214, 216 extends outward. Also, each sidewall 214, 216 may have a latch projection 218, 220, respectively. The sidewalls 214 and 216 may be capable of flexing outward such as when the connector cap 116 engages the contact sub-assembly 114. More specifically, as the connector cap 116 is inserted over the contact sub-assembly 114, each latch projection 218 and 220 slidably engages a corner or outer surface of the contact sub-assembly thereby exerting an outward force on the sidewalls 214 and 216, respectively. The latch projections 218 and 220 continue to slide along the outer surface of the contact sub-assembly 114 until the latch projections 218 and 220 clear and engage a latch opening (not shown) in the jack housing 109. In one embodiment, the connector cap 116 includes only one pair of opposing sidewalls 214 and 216 thereby reducing the width of the jack assembly 109. By reducing the width, an electrical system (not shown) may position several jack assemblies 109 adjacent to each other in order to use less space.

The connector cap 116 may also include center walls 260, 262, and 264, which project at a substantially perpendicular angle from the inner surface 210. The center walls 260, 262, and 264 provide structural integrity to the connector cap 116 so that, for example, the connector cap 116 does not accidentally disengage from the contact sub-assembly 114. As shown in FIG. 5, the crosswalls 170-177 stretch from one sidewall 214 or 216 to one center wall 260, 262, or 264. Furthermore, each crosswall 170-177 includes a first wall portion 222, a second wall portion 224, and a gap G that separates the wall portions 222 and 224 from each other. The wall portions 222 extend from one sidewall 214 or 216 and the wall portions 224 extend from a corresponding center wall 260, 262, or 264. In FIG. 5, the crosswalls 170-177 and corresponding wall portions 222 and 224 connect one sidewall to one center wall. Generally, the configuration of the crosswalls 170-177 and center walls 260, 262, and 264 are determined by the number, position, and orientation of the IDC's, corresponding conductor channels, and arms on the contact sub-assembly 114.

Furthermore, for each crosswall 170-177 the corresponding wall portions 222 and 224 may be equally sized or one portion may be greater than the other. For example, as shown in FIG. 5, the wall portion 224 of the crosswall 170 stretches a greater distance between the sidewall 214 and the center wall 260 than the wall portion 222. However, in the adjacent crosswall 171 the wall portion 222 stretches a greater distance between the sidewall 214 and the center wall 260 than the wall portion 224. As such the corresponding gaps G of the crosswalls 170 and 171 have a staggered relationship. In alternative embodiments, the wall portions 222 and 224 are sized such that the gaps G of the crosswalls 170-173 or the crosswalls 174-177 are aligned. Also shown in FIG. 5, each center wall 260, 262, and 264 has a planar top edge 360, 362, and 364. Furthermore, each crosswall 170-177 has a planar top edge 370. In one embodiment, each crosswall 170-177 has a depth D so that each crosswall 170-177 may press the corresponding conductor 190 a suitable distance into the slot 181 thereby displacing the insulation on the conductor 190 and forming an electrical connection with the conductor 190.

Figure 6A:
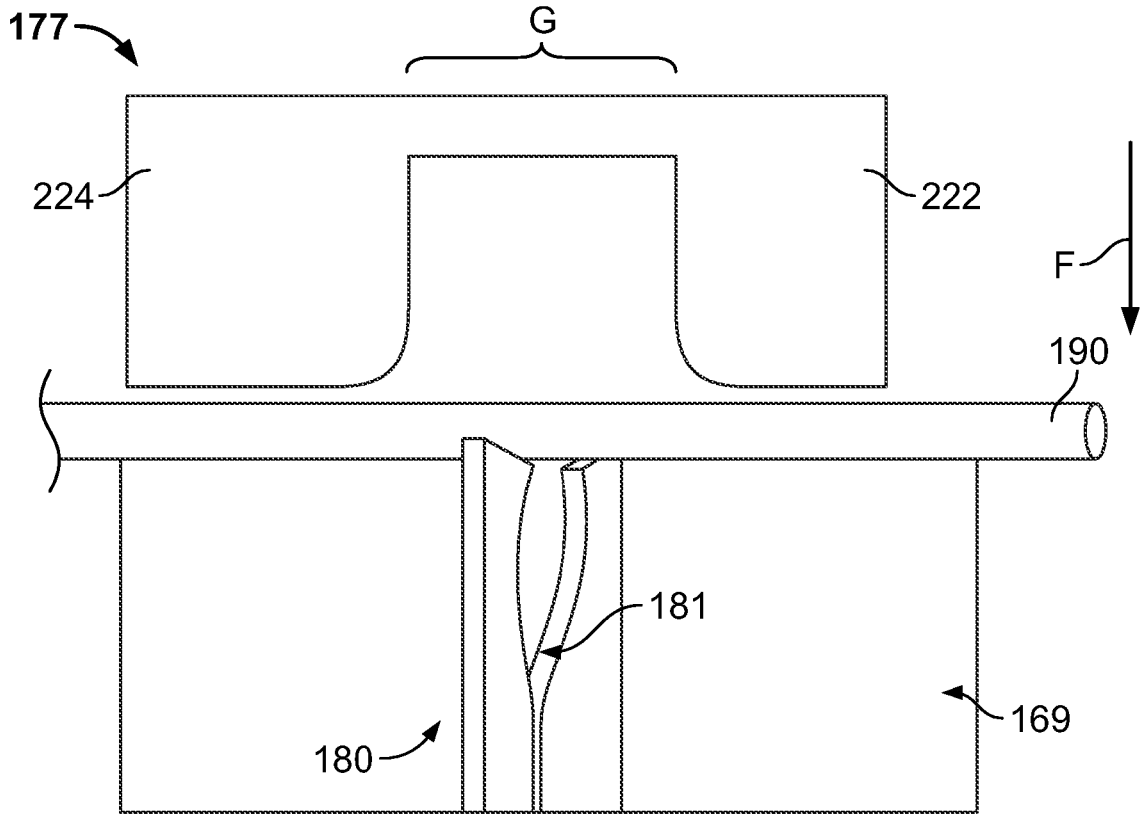
FIGS. 6A and 6B are side views of a portion of the contact sub-assembly shown in FIG. 3 while a wire conductor is pressed into a corresponding conductor channel and IDC slot.
Figure 6B:
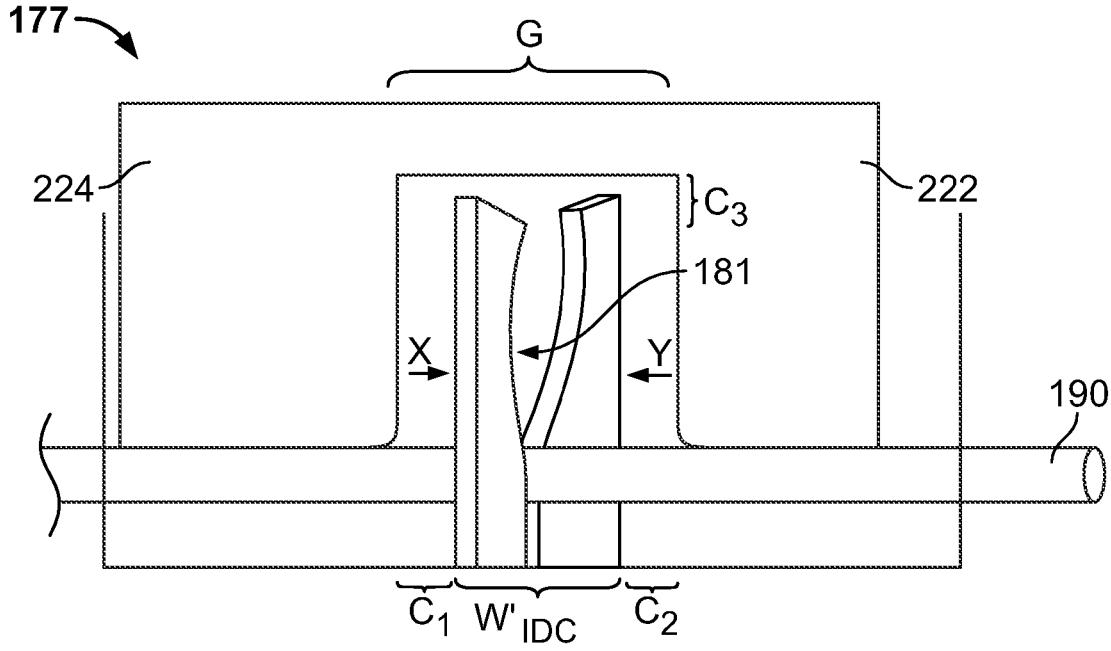

FIGS. 6A and 6B illustrate side views of the crosswall 177 and the conductor channel 169 as the crosswall 177 engages the insulated wire conductor 190 and advances the conductor 190 into the conductor channel 169 and corresponding IDC 180. As shown, when the axial force F is applied to the connector cap 116 (FIG. 2), the wall portions 222 and 224 contact the wire conductor 190 and advance the wire conductor 190 through the slot 181. When the connector cap 116 and the contact sub-assembly 114 (FIG. 3) are engaged, the wall portions 222 and 224 cooperate in providing strain relief for the wire conductor 190 and maintaining the wire conductor 190 in electrical contact with the IDC 180. As shown in FIG. 6B, the enlarged gap G provides a clearance $C_1$ between the position X of the IDC 180 and the wall portion 224 and also provides a clearance $C_2$ between position Y of the IDC 180 and the wall portion 222. Likewise, there is a clearance $C_3$ between the IDC 180 and the corresponding crosswall. The gap G and the resulting clearances $C_1$, $C_2$, and $C_3$ are configured to avoid formation of a conductive path between the conductor 190 and the conductive material of the crosswall 174 or, more specifically, first and second wall portions 222 and 224. In one embodiment, the gap G is twice the distance of the corresponding operative width $W'_{IDC}$.

Figure 7:
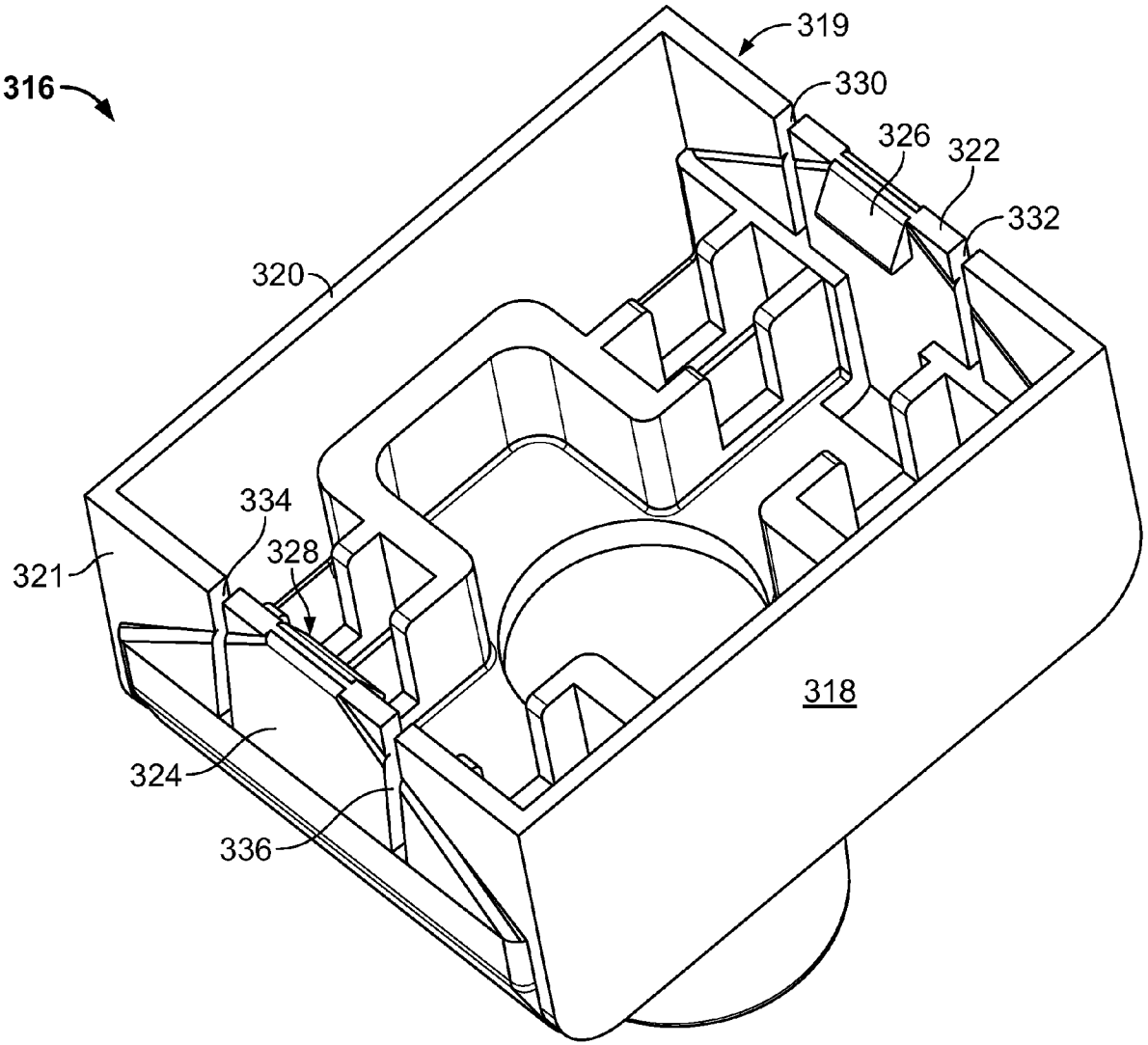
FIG. 7 is a perspective view of a connector cap formed in accordance with an alternative embodiment of the present invention.

FIG. 7 illustrates a connector cap 316 that is formed in accordance with an alternative embodiment. The connector cap 316 may include similar parts and components as those described in relation to the connector cap 116 (FIG. 5). Furthermore, the connector cap 316 may include a plurality of sidewalls 318-321 that surrounds the contact sub-assembly 114 (FIG. 2) when the connector cap 316 is coupled to the contact sub-assembly 114. In one embodiment, each sidewall 318-321 connects with adjacent sidewalls such that the contact sub-assembly 114 is completely surrounded by the sidewalls 318-321. Moreover, the opposing sidewalls 319 and 321 may include a tab portion 322 and 324, respectively. The tab portions 322 and 324 are separated from the corresponding sidewalls 319 and 321, respectively, by a pair of slits 330, 332, and 334, 336, respectively. The tab portions 322 and 324 include latch projections 326 and 328, respectively, and operate similarly to the sidewalls 214 and 216 discussed with reference to FIG. 5. Because the sidewalls 318-321 are all connected at the corners as shown in FIG. 7, the sidewalls 319 and 321 would not be capable of sufficiently flexing to engage the contact sub-assembly 114. Thus, the pairs of slits 334, 336 and 330, 332 allow tab portions 324 and 322, respectively, to flex outwardly when latch projections 328 and 326, respectively, engage an edge or outer surface of the contact sub-assembly 114.

Figure 8:
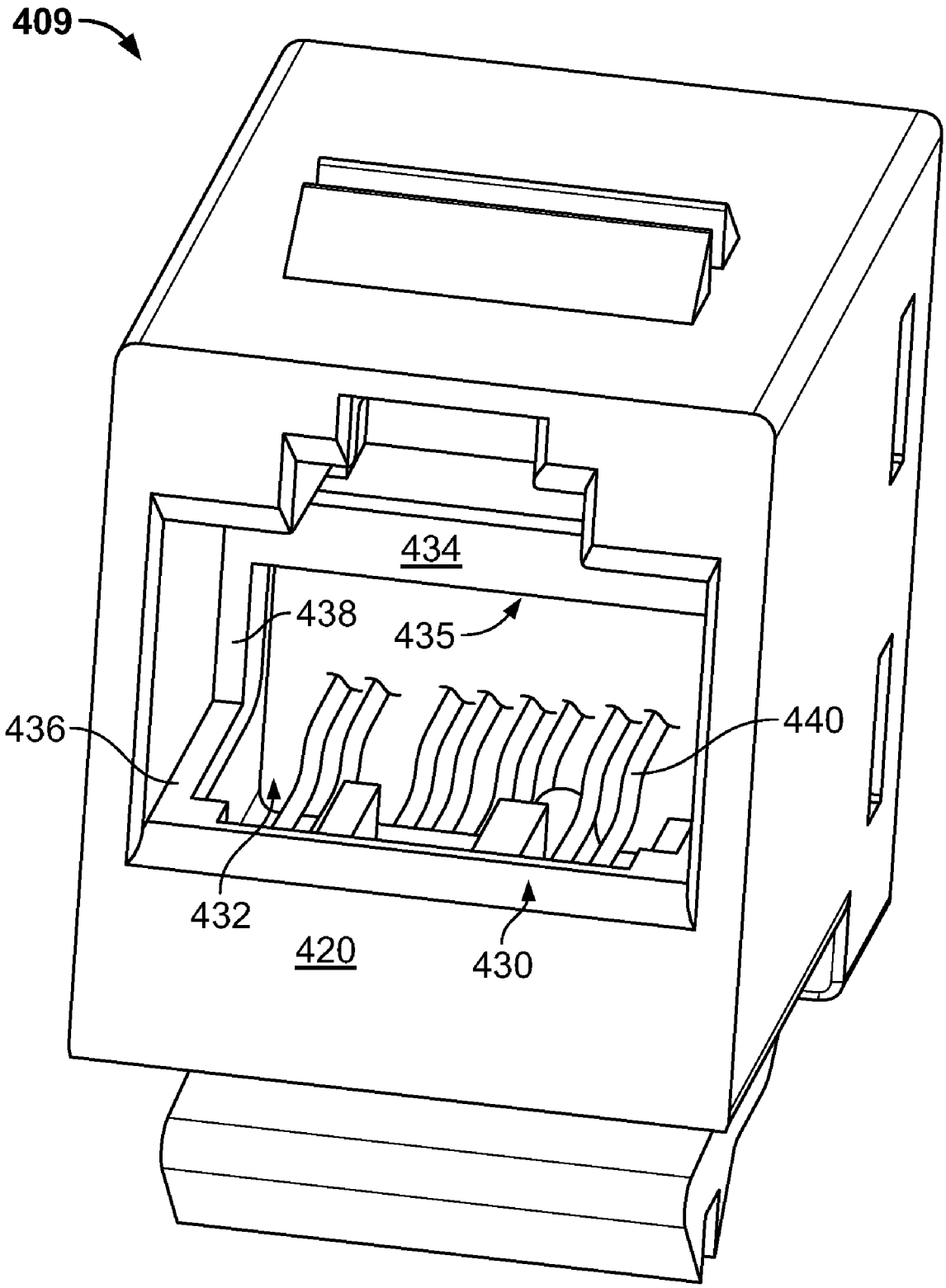
FIG. 8 is a rear perspective view of a housing that may be used with the electrical connector assembly shown in FIG. 1.

FIG. 8 is a perspective view of a jack housing 409 that may be formed in accordance with one embodiment. The jack housing 409 may be used with the connector cap 116, the connector cap 316, or be used with any other type of jack assembly. The jack housing 409 may be formed from a non-conductive material having conductive particles dispersed therein, such as the materials described above with reference to the connector cap 116. This material may have the same or a different composition as the material that is used to make the connector caps 116 and 316. Furthermore, the jack housing 409 may have similar parts and components as the jack housing 109 discussed above in relation to FIG. 2. As shown in FIG. 8, the jack housing 409 includes a front face 420 that forms an opening 430 configured to receive a plug (not shown). The jack housing 409 defines a cavity 432 that extends through the jack housing 409 and includes a plurality of cavity contacts 440 arranged therein. The jack housing 409 includes an interior wall 434 positioned within the cavity 432 that provides a positive stop to the plug when the plug is inserted through the opening 430. The cavity 432 also includes one or more guiding ledges 436 that run along a cavity surface and are configured to guide the plug as the plug advances through the cavity 432. Moreover, the cavity 432 may include one or more stop ledges 438 that extends from the guiding ledge 436 and connects to the interior wall 434. The stop ledge 438 also provides a positive stop for the plug when the plug is inserted into the cavity 432. As such, the interior wall 434 and the ledges 436 and 438 cooperate together in guiding and positioning the plug into a desired orientation such that the plug contacts (not shown) have a sufficient electrical connection with the cavity contacts 440.

In some conventional housings, the interior wall 434 includes an extension or overhang that projects toward the cavity contacts 440. However, the interior wall 434 of the jack housing 409 does not include an overhang but allows sufficient clearance between the conductive material of the interior wall 434 and the cavity contacts 440. For example, an edge 435 of interior wall 434 is substantially linear throughout. More specifically, in one embodiment, the interior wall 434, edge 435, guiding ledges 436, and/or stop ledges 438 are configured to avoid formation of a conductive path between a conductor 190 and/or the contacts 440 and the conductive material of the jack housing 409.

It is to be understood that the above description is intended to be illustrative, and not restrictive. As such, the above-described embodiments (and/or aspects thereof) may be used in combination with each other. For example, the connector cap 316 may be used with the jack housing 109, the jack housing 409, or any other electrical connector assemblies. Moreover, the contact sub-assembly 114 may be integrally formed with one of the jack housings 109, 409. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. For example, the crosswalls 170-177 may have different angles or orientations with respect to the sidewalls 214 and 216 and/or the center walls 260, 262, and 264, provided that the crosswalls 170-177 may be inserted into the corresponding conductor channels and have the appropriate clearance between the IDC 180 and the wall portions 222 and 224.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A jack assembly comprising:

a jack housing having a front end, a rear end, and a contact sub-assembly joined to the rear end, the front end forming an opening to a cavity for receiving a plug, the contact sub-assembly comprising a plurality of arms extending outwardly from the rear end of the jack housing and spaced apart to define a plurality of conductor channels, the contact sub-assembly further comprising an insulation displacement contact (IDC) held within each of the plurality of conductor channels, wherein the IDC extends across the conductor channel such that, when a conductor is inserted into the IDC, the conductor rests within the conductor channel; and a connector cap mounted to the jack housing, the connector cap having a body arranged to at least partially cover the contact sub-assembly, the cap being formed from a non-conductive material having conductive particles dispersed therein, the body comprising an inner surface and a plurality of crosswalls projecting outwardly from the inner surface, each crosswall having first and second wall portions separated by a gap, wherein each crosswall is positioned to be inserted into one of the plurality of conductor channels such that the IDC fits within the gap.

2. The jack assembly in accordance with claim 1 wherein the first and second wall portions are spaced apart from the IDC to avoid formation of a conductive path between the first and second wall portions and the conductor held within the IDC.

3. The jack assembly in accordance with claim 1 further comprising a plurality of contacts extending from the front end to the rear end of the jack housing, the jack housing comprising a non-conductive material having conductive particles dispersed therein, wherein the cavity is configured to avoid formation of a conductive path between the jack housing and the contacts.

4. The jack assembly in accordance with claim 1 further comprising a plurality of contacts extending from the front end to the rear end of the jack housing, wherein the front end opening and cavity are configured to avoid formation of a conductive path between the jack housing and the contacts.

5. The jack assembly in accordance with claim 1 wherein a portion of the connector cap is color-coded with a paint.

6. The jack assembly in accordance with claim 1 wherein the IDC is positioned within an IDC channel formed by the adjacent arms, the IDC channel and the conductor channel intersecting each other at a non-orthogonal angle.

7. The jack assembly in accordance with claim 1 wherein each IDC has an operative width and each gap has a gap width, wherein the gap width is at least twice the operative width of the IDC.

8. The jack assembly in accordance with claim 2 further comprising a plurality of contacts extending from the front end to the rear end of the jack housing, the jack housing comprising the non-conductive material having conductive particles dispersed therein, wherein the cavity is configured to avoid formation of a conductive path between the jack housing and the contacts.

9. An electrical connector cap configured to push a plurality of conductors into corresponding insulation displacement contacts (IDCs) when the connector cap is mounted to a jack housing, each IDC extending across a conductor channel such that when a conductor is inserted into the IDC the conductor rests within the conductor channel, the connector cap comprising:

a body being formed from a non-conductive material having conductive particles dispersed therein, the body having an inner surface; and a plurality of crosswalls projecting outwardly from the inner surface, each crosswall having first and second wall portions separated by a gap, each crosswall positioned to be inserted into a corresponding conductor channel such that the IDC fits within the gap when the first and second wall portions push the corresponding conductor into the conductor channel.

10. The connector cap in accordance with claim 9 wherein each IDC has an operative width and each gap has a gap width, wherein the gap width is at least twice the operative width of the IDC.

11. The connector cap in accordance with claim 9 further comprising only one pair of opposing sidewalls projecting outward from the inner surface and perpendicular to the inner surface.

12. The connector cap in accordance with claim 9 further comprising a paint for color-coding the connector cap.

13. The connector cap in accordance with claim 9 wherein the inner surface includes a nozzle opening for receiving a cable having a plurality conductors.

14. The connector cap in accordance with claim 9 wherein the non-conductive material comprises a thermoplastic polymer and the conductive particles comprise stainless steel fibers.

15. The connector cap in accordance with claim 9 wherein the connector cap does not include a conductive coating and/or conductive shield for reducing EMI.

16. A jack assembly for interconnecting cables, the jack assembly comprising:

a jack housing having a cavity configured to engage a plug from a first cable;

a conductor channel formed at an end of the jack housing, the conductor channel configured to receive a conductor from a second cable;

an insulation displacement contact (IDC) held within the conductor channel, the IDC extending across the conductor channel such that the conductor rests within the conductor channel when the conductor is inserted into the IDC; and a connector cap configured to be mounted to the end of the jack housing to cover the conductor channel, the cap being formed from a non-conductive material having conductive particles dispersed therein, the cap comprising a crosswall that is sized and shaped to be inserted into the conductor channel when the cap is mounted to the jack housing, the crosswall having first and second wall portions separated by a gap, the IDC fitting within the gap when the crosswall is inserted into the conductor channel.

17. The jack assembly in accordance with claim 16 wherein the first and second wall portions are spaced apart from the IDC to avoid formation of a conductive path between the first and second wall portions and the conductor held within the IDC.

18. The jack assembly in accordance with claim 16 wherein the conductor channel includes a plurality of conductor channels and the IDC includes a plurality of IDCs, each IDC being held within and extending across a corresponding conductor channel.

19. The jack assembly in accordance with claim 16 further comprising a contact sub-assembly joined to the end of the jack housing, the contact sub-assembly forming the conductor channel.

20. The jack assembly in accordance with claim 16 wherein the gap is shaped to form a clearance between the IDC and the crosswall to avoid formation of a conductive path therebetween.

* * * * *